United States Patent [19]

Gracia

[11] 4,109,478

[45] Aug. 29, 1978

[54] UNITIZED CONDUCTOR GUIDE AND FRAME FOR OFFSHORE DRILLING AND PRODUCTION

[75] Inventor: Bert E. Gracia, Houston, Tex.

[73] Assignee: Brown & Root, Inc., Houston, Tex.

[21] Appl. No.: 867,116

[22] Filed: Jan. 5, 1978

[51] Int. Cl.[2] ..... E02D 17/00

[52] U.S. Cl. ..... 61/86; 61/110; 166/335; 166/366; 175/7; 175/9

[58] Field of Search ..... 61/86, 87, 88, 90, 91, 61/92, 93, 94, 96, 97, 98, 99, 100, 102, 105, 106, 110, 111; 166/0.5, 0.6; 175/7, 9

[56] References Cited

U.S. PATENT DOCUMENTS

| | | | |
|---|---|---|---|
| 3,429,133 | 2/1969 | Hauber | 61/89 |
| 4,023,371 | 5/1977 | Bryant, Jr. | 61/110 |

*Primary Examiner*—Jacob Shapiro
*Attorney, Agent, or Firm*—Kenway & Jenney

[57] ABSTRACT

A novel guide member and guide member support arrangement for guiding a drill conductor from a deck portion of an offshore platform into the bottom of a body of water is disclosed. The guide member is snugly nestled against and positioned within the guide member support which directly provides lateral and vertical support for the guide member. The guide member has an upper funnel-shaped portion and a lower cylindrical portion. The guide member support comprises the plurality of connected structural members arranged in a plane for defining a support opening for the guide member. The guide member is connected to the guide member support at at least three positions.

5 Claims, 6 Drawing Figures

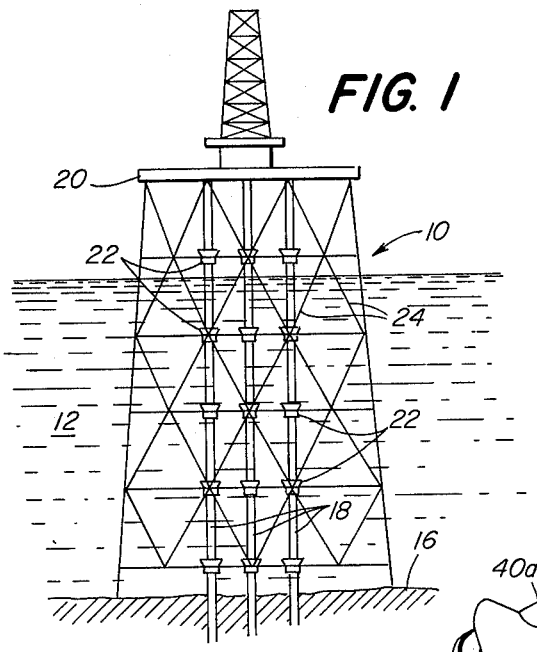
FIG. 1
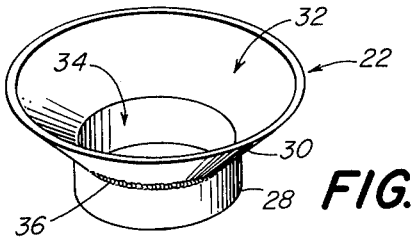
FIG. 2
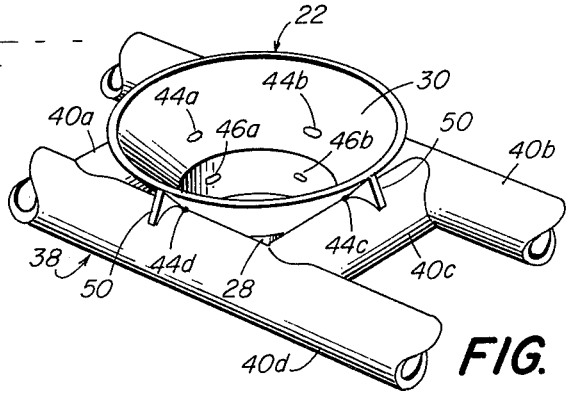
FIG. 4
FIG. 5
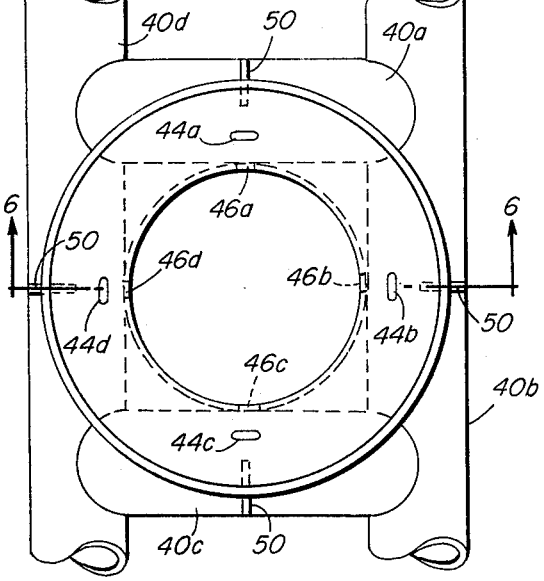
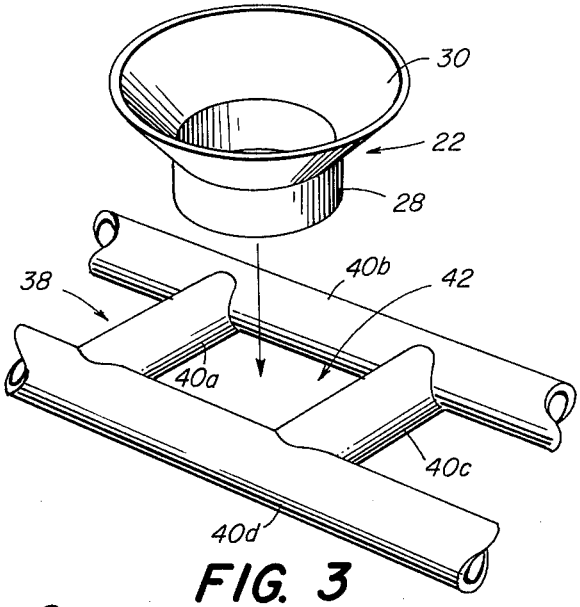
FIG. 3
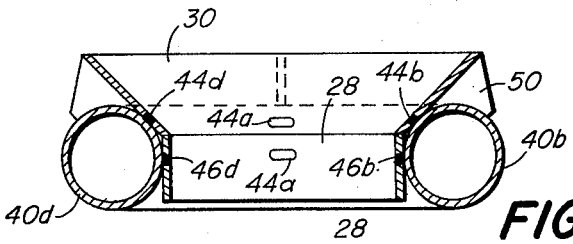
FIG. 6

UNITIZED CONDUCTOR GUIDE AND FRAME FOR OFFSHORE DRILLING AND PRODUCTION

The invention relates generally to offshore drilling structures, and in particular, to conductor guide members for guiding drill conductors from a deck portion of an offshore platform to and into the water bottom.

BACKGROUND OF THE INVENTION

During the recovery of fluids, such as oil, from offshore formations below the bottom of a body of water, it is typical to provide a plurality of offshore wells which extend into the bottom of the body of water from the deck portion of offshore platforms constructed or erected in the water. Generally, each well includes a drill conductor extending from the deck portion of the offshore platform down through the platform structure, and into the water bottom. Advantageously, as the drill conductors pass through the platform structure, guide members are provided first, to guide the drill conductor into the water bottom at a relatively konwn location and at a known angle or inclination, and second, to support the drill conductor against movement in the horizontal plane.

Prior to the present invention, the guide members, which usually take the general form of a funnel having a wide receiving end and a narrower exit end, have been connected indirectly to structural support members of the platform. As a result, large expenditures of time have generally been required to weld the support members securely in place, that is, to secure, by welding, the large number of vertical and horizontal support panels connected between the various platform structural members and the guide member. The result is a guide member which does not directly contact any platform structural member. Inasmuch as there may be, for example, twenty-five or more conductors extending from the deck of a single offshore platform, with each conductor utilizing from two to five or more guide members, it quickly becomes clear that even a modest savings in the cost of constructing and installing each guide member is worthwhile and important.

It is therefore a principal object of the invention to provide a simple construction of an apparatus for guiding a drill conductor which is reliable and yet has a minimum fabrication cost. Other objects of the invention are to provide apparatus for guiding the drill conductor which requires a minimum number of fabrication steps, which is strong, which requires a minimum of raw materials, and which is compatible with the platform structural members.

SUMMARY OF THE INVENTION

An apparatus for guiding a drill conductor from a deck portion of an offshore platform situated in a body of water, into the bottom of the body of water features at least one guide member, and at least one guide member support structure. Each guide member has an upwardly directed, outwardly flanged, funnel-shaped portion, the portion having a conductor receiving upper opening and a smaller, conductor guiding exit aperture. Each guide member further has a downwardly directed cylindrical member integrally connected to the funnel-shaped portion at the conductor exit aperture to form a substantially continuous interior guide surface for the conductor. Each guide member support has a plurality of structural members (preferably tubular) arranged substantially in a plane for defining a support opening for passing the cylindrical member of an associated guide member and for supporting the funnel-shaped portion of the associated guide member so that the funnel-shaped portion is in contiguous contact with the structural members at at least a plurality of contact positions. For each guide member-guide member support pair, the funnel-shaped portion contacts the structural members of the guide member support at at least three positions. Further, the cylindrical member of each pair is snugly nestled against and is in position within the guide member support, and the guide member and the guide member support are secured to each other at a plurality of contacting positions.

In a particular embodiment of the invention, the guide member has a circular cross-sectional area, the guide member support has a substantially square support opening, there are four contact positions between the funnel-shaped portion and the tubular structural members, and at each of these four positions the guide member is secured to the guide member support by a weld.

In the particular illustrated apparatus, the cylindrical member of each guide member is connected to the tubular members of the associated guide member support at each of four positions and the support is thus directly secured to the guide member to inhibit movement in both the vertical and horizontal planes.

DESCRIPTION OF THE DRAWINGS

Other objects, features, and advantages of the invention will appear from the following description of a preferred embodiment of the invention taken together with the drawings in which:

FIG. 1 is an elevation view of a drilling or production platform having conductors running from a deck portion to below the water bottom;

FIG. 2 is a perspective view of a typical guide member according to the invention;

FIG. 3 is an exploded assembly perspective of the guide member and guide member support according to the invention;

FIG. 4 is a perspective view of a typical guide member and guide member support construction in a supporting relationship according to the invention;

FIG. 5 is a top plan view of the guide member and guide member support of FIG. 4; and FIG. 6 is a cross-sectional view along lines 6—6 of FIG. 5.

DESCRIPTION OF A PREFERRED EMBODIMENT

Referring to FIG. 1, a typical offshore platform 10, situated in a body of water 12 stands on the bottom 16 of the body of water. The offshore platform includes a plurality of drill conductors 18 which extend from a deck portion 20 to a predetermined depth below the water bottom 16. A plurality of guide members 22 are secured to the tubular structure 24 of the platform (1) to guide the conductors during installation so that they are accurately positioned on the bottom of the body of water and (2) to provide support against movement of the conductors in the horizontal plane during use to prevent vibration and other structural forces from adversely affecting or damaging the drill conductors.

Referring to FIG. 2, each guide member 22 has a downwardly directed hollow cylindrical member 28 which is integrally connected to an upwardly directed, outwardly flanged, funnel-shaped portion 30. The funnel-shaped portion defines at its upper end, a conductor receiving upper opening 32 and at its lower end, a smaller conductor guiding exit aperture 34. The cylindrical member has a cross-sectional opening which is congruent with the conductor exit aperture whereby the guide member provides a substantially continuous interior guide surface for the conductors. The funnel-shaped portion and the cylindrical member are connected along a mating peripheral circumference 36, in any convenient manner, for example, by a weld.

Referring to FIGS. 3 and 4, each guide member is snugly nestled against, positioned within, and supported by an associated guide member support structure 38. The guide member support has a plurality of connected tubular structural members 40*a*, 40*b*, . . . , arranged substantially in a plane, which define a guide member support opening 42 for receiving the guide member. The guide member is inserted into the opening 42 defined by the tubular members of the guide member support and is axially aligned with the opening. Each guide member-guide member support pair is in contact at at least three and preferably at least four positions 44*a*, 44*b*, 44*c*, 44*d*, at which positions the guide member rests directly on, is supported by, and is preferably welded to the tubular structural members. In the illustrated embodiment, the opening defined by tubular members 40*a*, 40*b*, . . . is substantially square, the length of one side corresponding in size to the diameter of the circular cross-section of cylindrical member 28.

Referring to FIG. 5, the cylindrical member 28 is also connected, preferably by a weld, to the tubular members 40*a*, 40*b*, 40*c*, 40*d* at each of four positions, 46*a*, 46*b*, 46*c*, 46*d* respectively at the position at which the cylindrical member and the tubular members are in closest and preferably actual contact. Thus, in the preferred embodiment, the guide member 22 is secured to the guide member support directly at eight positions, the positions corresponding to the four compass positions, north, south, east and west. In this manner, referring to the cross-sectional view of FIG. 6, the tubular supports 40 provide direct support for the guide member without using the intermediate supports or flanges of the prior art which space the guide member away from and out of direct contact with the supporting tubular structure.

Referring to FIGS. 5 and 6, the guide member and guide member support structure may further include a plurality of vertically oriented supporting panels 50 which are connected between the outwardly flanged funnel-shaped member 30 of the guide member along its outside periphery and the tubular members 40 for example, by welding. Members 50, which may be planar, are provided to give additional vertical support to the upwardly and outwardly directed flange portion 30.

SUMMARY OF THE ADVANTAGES OF THE INVENTION AND UNOBVIOUSNESS

The guide member and guide member support according to the present invention provide a uniquely simple support structure for guiding drill conductors from the deck portion of an offshore platform to and into the water bottom. The guide member and support, according to the claimed invention, provide a structure which is lower in weight than previous structures and which requires less fabrication time and hence is less expensive to fabricate than previous structures. In addition to the clearly advantageous cost advantages, the guide member rests directly on the support structure without intermediate supporting elements and a more direct support is provided whereby the moments and stresses encountered by the various components of the apparatus is lessened.

The invention further advantageously nestles the guide member solidly within a well defined opening of the supporting structure. As a result, the cylindrical portion of the guide member receives lateral support in the horizontal plane which is more direct than the support previously offered in the prior art.

The guide members and guide member supports used by earlier workers in this area are shown, for example, in FIG. 3 of Mott et al, U.S. Pat. No. 3,670,507, issued June 20, 1972. As noted by Mott et al, at column 3, lines 28–39, the guide member is connected to the supporting structure using gussets 30. It is these indirect connecting elements which the present invention advantageously eliminates by providing a guide member and guide member support structure in which the guide member contacts and is nestled within the support structures themselves so that the guide member may be directly welded to the tubular members of the support. This nestled construction thereby automatically provides the lateral and vertical support for the guide member necessary to ensure precise alignment of the drill conductor as it is being installed. Furthermore, as noted above, the amount of welding required to secure the guide member is significantly reduced by eliminating the unnecessarily complicating indirect supports from the structure. This seemingly simple step of removing the intermediate structural supports (which require an extraordinary amount of time consuming welding) has escaped the skilled workers in the art. Thus, the unobvious removal of the supports, which have hitherto been considered an essential structural member of the guide member/guide member support assembly, provides, in addition to reduced fabrication costs, a structure which is easier to assemble and secure against the surging forces which may occur as the drill conductor is installed and used.

Another example of a guide member and guide member support used previously is described in Harrison et al, U.S. Pat. No. 3,987,639, issued Oct. 26, 1976, and assigned to the assignee of this invention. While not directly described in Harrison et al, the gussets of the guide assembly may be seen in FIG. 10, although the gusset panels are not specifically referred to with a reference number.

Additions, subtractions, deletions, and modifications of the various structural members described in the preferred embodiment of the invention will be obvious to those skilled in the art and are within the scope of the following claims.

What is claimed is:

1. Apparatus for guiding a drill conductor from a deck portion of an offshore platform, situated in a body of water, into the bottom of said body of water, comprising at least one guide member, each said guide member comprising an upwardly directed, outwardly flanged, funnel-shaped portion having a conductor receiving upper opening and a smaller, conductor guiding exit aperture, and a downwardly directed hollow cylindrical member integrally connected to the funnel-shaped portion at the conductor exit aperture to form a substantially continuous interior guide surface for said conductor, at least one guide member support structure, each said guide member support structure comprising a plurality of connected structural members supported by said platform and arranged substantially in a plane for defining a support opening for passing said cylindrical member of an associated guide member, and for supporting said funnel-shaped portion of said associated guide member, said funnel-shaped portion being in contiguous contact with said structural members at at least a plurality of contact positions, and for each guide member-guide member support pair, said funnel-shaped portion contacts said structural members at at least three positions, said cylindrical member is snugly nestled against and positioned within said guide member support opening, and said guide member and said guide member support are secured to each other at a plurality of said contacting positions.

2. The apparatus of claim 1 wherein said structural members are tubular structural members.

3. The apparatus of claim 2 wherein said guide member has a circular cross-section area, said guide member support opening has a substantially square area, there are four contacting positions between said funnel-shaped portion and said tubular structural members, and said guide member is secured to said guide member support at said four positions by a weld.

4. The apparatus of claim 3 wherein said cylindrical member of each guide member is welded to the tubular members of the associated guide member support at each of four positions, and said support directly secures said guide member against movement in both the vertical and horizontal planes.

5. The apparatus of claim 2 wherein each guide member further comprises a plurality of vertically directed panel members extending downward from said funnel-shaped member and in contact with and secured between said tubular members and said funnel-shaped member, for providing vertical support to said guide member.

* * * * *